US005780213A

United States Patent [19]

Ozaki et al.

[11] Patent Number: 5,780,213

[45] Date of Patent: Jul. 14, 1998

[54] PHOTOGRAPHIC PRINTING PAPER SUPPORT

[75] Inventors: Kazuo Ozaki; Tadahiro Kegasawa, both of Shizuoka-ken; Ryuichi Katsumoto, Tokyo, all of Japan

[73] Assignee: Fuji Photo Film Co., Ltd., Kanagawa, Japan

[21] Appl. No.: 924,842

[22] Filed: Sep. 5, 1997

Related U.S. Application Data

[63] Continuation of Ser. No. 508,089, Jul. 27, 1995, abandoned, which is a continuation of Ser. No. 362,165, Dec. 22, 1994, abandoned.

[30] Foreign Application Priority Data

Dec. 22, 1993 [JP] Japan ..... 5-346065

[51] Int. Cl.[6] ..... G03C 1/775

[52] U.S. Cl. ..... 430/538; 430/523; 430/536; 430/537

[58] Field of Search ..... 430/523, 536, 430/537, 538

[56] References Cited

U.S. PATENT DOCUMENTS

| | | | |
|---|---|---|---|
| 3,501,298 | 3/1970 | Crawford | 430/536 |
| 3,783,003 | 1/1974 | Matsuhisa et al. | 427/158 |
| 4,352,861 | 10/1982 | von Meer et al. | 430/538 |
| 4,389,455 | 6/1983 | Asao | 430/538 |
| 4,447,524 | 5/1984 | Uno et al. | 430/538 |
| 4,645,736 | 2/1987 | Anthonsen et al. | 430/538 |
| 4,801,509 | 1/1989 | Uno et al. | 430/538 |
| 5,252,447 | 10/1993 | Ohtani et al. | 430/538 |
| 5,326,624 | 7/1994 | Tsubaki et al. | 430/538 |
| 5,429,916 | 7/1995 | Ohshima | 430/523 |
| 5,466,519 | 11/1995 | Shirakura et al. | 430/523 |

FOREIGN PATENT DOCUMENTS

| | | | |
|---|---|---|---|
| 0400522 | 12/1990 | European Pat. Off. . | |
| 64542 | 1/1985 | Japan . | |
| 0237056 | 10/1988 | Japan | 430/538 |
| 0142549 | 6/1989 | Japan | 430/538 |
| 0361038 | 3/1991 | Japan . | |
| 0256947 | 9/1992 | Japan . | |
| 4256947 | 9/1992 | Japan . | |
| 4256948 | 9/1992 | Japan . | |
| 1339045 | 11/1973 | United Kingdom . | |
| 2088747 | 6/1982 | United Kingdom . | |

*Primary Examiner*—Geraldine Letscher
*Attorney, Agent, or Firm*—Sughrue, Mion, Zinn, Macpeak & Seas, PLLC

[57] ABSTRACT

Disclosed is a photographic printing paper support having waterproof resin layers on both sides of a substrate, with the waterproof resin layer on the emulsion-coated side comprising at least an upper layer containing from 5 to 25% by weight of titanium oxide and from 0 to 0.56% by weight of a blueing agent and a lower layer containing substantially no titanium oxide but containing from 0.05 to 0.60% by weight of a blueing agent, and wherein the upper layer contains less blueing agent than the lower layer.

10 Claims, 4 Drawing Sheets

PHOTOGRAPHIC PRINTING PAPER SUPPORT

This is a File Wrapper continuation of application Ser. No. 08/508,089 filed Jul. 27, 1995 (now abandoned), which is a File Wrapper continuation of application Ser. No. 08/362,164 filed on Dec. 22, 1994 (now abandoned).

FIELD OF THE INVENTION

The present invention relates to a photographic printing paper support and, more particularly, to a support which can provide an excellent resolving power when it is applied to a photographic printing paper, and that at a lower cost than conventionally used supports.

BACKGROUND OF THE INVENTION

Hitherto, supports coated with resins on both sides are known as those suitable for photographic printing paper. In particular, it deserves due notice that the resin coat provided on the emulsion-coated side (the front resin layer) contains an inorganic pigment such as titanium oxide, etc., a bluing agent (including blue pigments), a brightening agent and so on (as described in U.S. Pat. No. 3,501,298) (cf., FIG. 3 illustrated hereinafter).

In those supports, it is known that the titanium oxide used therein not only functions so as to heighten the water resistance and the light reflecting efficiency of the supports, but also can provide higher resolving power the more its content therein is increased.

However, an increase in the content of expensive titanium oxide causes a raise in the cost of the resulting product. Moreover, the increase of the titanium oxide content involves a disadvantage of causing an utter lack of production suitability, because it soils die lips and causes the appearance of fine grains on the resin coat surface, or the generation of the so-called microglid.

With the intention of decreasing the titanium oxide content, therefore, it was carried out to divide the front resin layer into two constituent layers and incorporate titanium dioxide into the upper constituent layer alone (on the emulsion-coated side, as shown hereinafter in FIG. 2), as disclosed in JP-B-49-30446 (the term "JP-B" as used herein means an "examined Japanese patent publication").

However, the countermeasure described above proved not only to have small effect upon the improvement of the resolving power, since the $TiO_2$-free lower constituent layer to go straight through and to scatter randomly on the support surface thereby lowering the resolving power, but also to be inadequate for satisfactory reduction in the cost of the resulting product because it brought about a slight decrease in the amount of titanium oxide used.

With the invention of improving the above-described production suitability, on the other hand, it was carried out to divide the front resin layer into two constituent layers and design so that not only the titanium oxide content may be higher in the upper constituent layer than in the lower constituent layer but also the upper constituent layer may be thinner than the lower constituent layer, as disclosed in JP-A-64-542 (the term "JP-A" as used herein means an "unexamined published Japanese patent application), or so that not only the titanium oxide content may be lower in the upper constituent layer than in the lower constituent layer but also the upper constituent layer may be thinner than the lower constituent layer, as disclosed in JP-A-01-142549.

However, those methods, although the both introduced an improvement in the production suitability, didn't made any substantial reduction in the amount of titanium oxide used. Consequently, they failed in reduction of costs of the resulting products.

In addition, while it was not a photographic printing paper support, a laminated sheet was developed for graphic arts (JP-A-03-61038). Such a sheet has two or more resin layers laminated on the front side of a sheet-form support, and contains titanium oxide in the topmost resin layer alone. Further, the topmost resin layer thereof is thinner than the other lower layers.

Although it is excellent in printability, writing quality and so on, the laminated sheet described above has a defect that it cannot provide sufficient resolving power when it is used as photographic printing paper support.

As for the blueing agent, on the other hand, only its function to modify the color hinge of a $TiO_2$-containing photographic support has been examined by those skilled in the art (as described, e.g., in JP-A-04-256947). In general, the amount of blueing agent added to ensure a desired color tinge in a photographic support depends mainly on the amount of $TiO_2$ used together therewith.

In order to solve the problem of ensuring high resolving power with a reduced amount of titanium oxide, the present inventors have made intensive studies. As a result thereof, it has now been found out that a blueing agent has a significant effect upon the improvement of resolving power, and the fuzzy image formation attributable to a printing operation can be prevented and the content of titanium oxide can be reduced and the total amount of a blueing agent added can be minimized as the resolving power is kept high to result in reduction of the product cost when a waterproof resin layer provided on the emulsion-coated side of a support is constituted of two layers, the upper layer of which contains specified amounts of titanium oxide and bluing agent and the lower layer of which contains a bluing agent alone, wherein the upper layer contains less blueing agent than the lower layer thereby achieving the present invention.

SUMMARY OF THE INVENTION

Therefore, an object of the present invention is to provide a photographic printing paper support which has excellent production suitability and high resolving power and can be produced at a lower cost than conventional ones.

The above-described object is attained with a photographic printing paper support having waterproof resin layers on both sides of a substrate, with the waterproof resin layer on the emulsion-coated side comprising at least an upper layer containing from 5 to 25% by weight of titanium oxide and from 0 to 0.56% by weight of a bluing agent and a lower layer containing substantially no titanium oxide but containing from 0.05 to 0.60% by weight of a bluing agent wherein the upper layer contains less blueing agent than the lower layer.

In these views, the reference number 1 represents a substrate, the reference numbers 2, 3 and 4 represent waterproof resin layers respectively, the reference number 5 represents a bluing agent, and the reference number 6 represents a titanium oxide.

Figure 4:
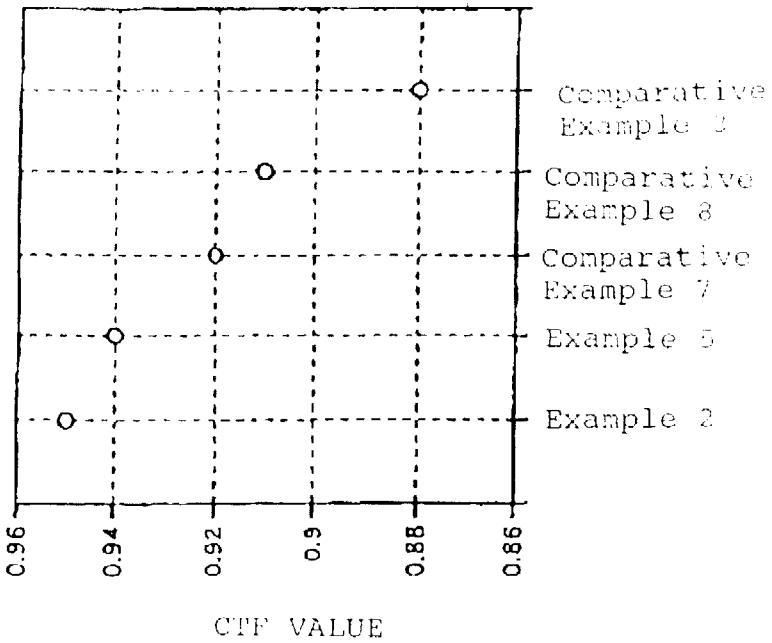

FIG. 4 charts the CTF value for inventive versus comparative printing papers.

Figure 5:
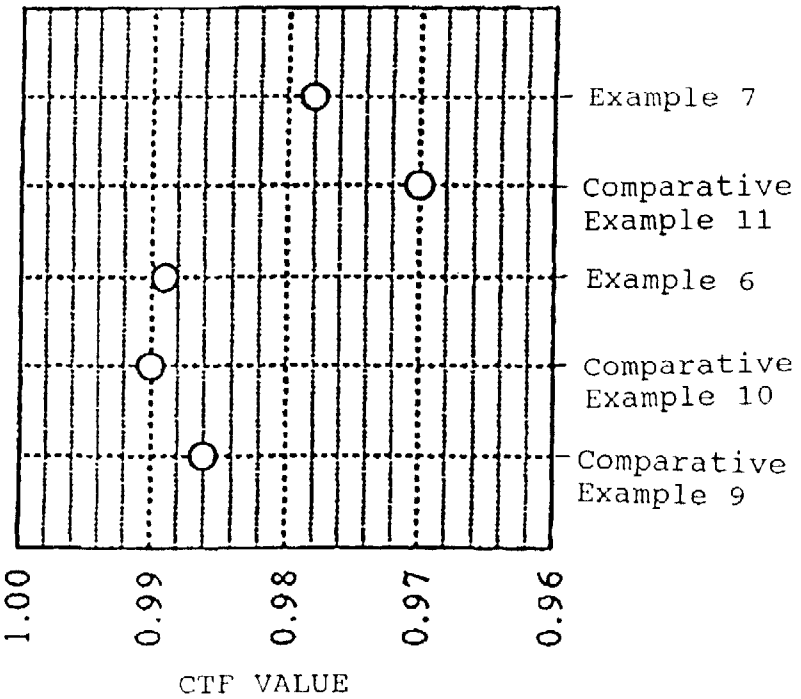

FIG. 5 charts the CTF value for inventive versus comparative printing papers, in which the amount of blueing agent was increased over that used in the samples shown in FIG. 4.

DETAILED DESCRIPTION OF THE INVENTION

The waterproof resins used for forming resin layers in the present invention can be properly chosen from resins of the kind which can undergo melt extrusion at a temperature ranging from 170° to 290° C. As the resins of such a kind, it is general to use polyolefins, such as polyethylene, polypropylene, etc., and polyester resins. Of these resins, polyethylene is preferred over the others. As for the polyethylene, any sort of polyethylene, a high-density, low-density or linear low-density polyethylene, may be used. Additionally, these polyethylenes may be used independently or as a mixture of two or more thereof.

In particular, it is preferable that the waterproof resin used in the foregoing lower resin layer provided in contact with a substrate on the emulsion-coated side be a resin having a melt flow rate in the range of 1.2 to 100 g per 10 minutes from the standpoint of securing satisfactory adhesiveness between the resin layer and the substrate. Also, it is desirable to use waterproof resins having their melt flow rates in the range of 1.2 to 100 g per 10 minutes for resin layers other than the lower resin layer on the emulsion-coated side.

Additionally, the foregoing lower resin layer may have one or more constituent layers.

The lowest waterproof resin layer provided on the emulsion-coated side can contain a tackifier resin and/or an adhesive resin, such as an acid-modified polyolefin resin capable of hot-sealing waterproof resins, an ionomer, etc., for the purpose of improvement upon the adhesiveness to both the layer provided thereon and the substrate.

Suitable examples of such a tackifier resin include resins derived from rosin, terpene resins (such as β-pinene polymer), cumarone-indene resin, petroleum hydrocarbon resins and so on.

A tackifier resin as cited above is generally admixed with the foregoing waterproof resin in a proportion of from 0.5 to 60% by weight.

Specific examples of an adhesive resin as described above include an acid-modified polyolefin resin, an ionomer, an ethylene-vinyl acetate copolymer resin (EVA resin), an ethylene-ethylacrylate copolymer resin (EEA resin), an ethylene-acrylic acid copolymer resin (EAA resin) and a metal salt thereof. The proportion of such an adhesive resin to the foregoing waterproof resin admixed therewith ranges from 20 to 500% by weight.

It is preferable for the upper waterproof resin layer on the emulsion-coated side to contain a bluing agent in addition to titanium oxide. In the lower waterpoof resin layer, on the other hand, from 0.05 to 0.60% by weight of bluing agent is contained, but titanium oxide is not contained in a substantial sense.

As for the titanium oxide used in the upper waterproof resin layer, titanium dioxide is used to advantage because it can ensure higher resolving power to the product.

It is desirable that the content of titanium oxide in the upper layer be in the range of 5 to 25% by weight, particularly preferably 10 to 20% by weight. When titanium oxide is used in a content lower than 5% by weight, the resulting photographic printing paper cannot achieve sufficiently high resolving power; whereas when the content of titanium oxide is increased beyond 25% by weight, not only the production cost of the support is raised but also the resulting resin layer lacks in production suitability because it tends to generate cracks and suffer die lines.

Additionally, the foregoing expression "titanium oxide is not contained in a substantial sense" means that the content of titanium oxide is not higher than 3% by weight.

As for the structure of titanium oxide, both rutile and anatase structures may be adopted. However, anatase-type, titanium oxide is preferred when priority is given to the achievement of high whiteness; while rutile-type titanium oxide is preferred when priority is given to the achievement of high sharpness. On the occasion both whiteness and sharpness are taken into account, on the other hand, a blend of anatase-type titanium oxide and rutile-type titanium oxide may be used, or the titanium oxide-containing layer may be subdivided into two layers, namely a layer to which anatase-type titanium oxide is added and a layer to which rutile-type titanium oxide is added.

It is desirable that the average grain size of titanium oxide used be in the range of 0.1 to 0.4 μm. When the titanium oxide has an average grain size less than 0.1 μm, it is difficult to incorporate such titanium oxide in a resin layer in a homogeneously mixed and dispersed condition; while when the titanium oxide has an average grain size greater than 0.4 μm, it not only fails to provide sufficient whiteness but also forms projections at the resin layer surface to exert a bad influence upon image quality.

Specific examples of titanium oxide having such a structure and an average grain size as described above include the products commercially available under the trade names of KA-10 and KA-20 (products of Titan Kogyo Co., Ltd.), and A-220, PF-656, PF-654, PF-671, PF-715 and CR-63 (products of Ishihara Industry Co., Ltd.).

In using those titanium oxide products, they are generally subjected to a surface treatment for the purpose of depressing their activity to inhibit the yellowing phenomenon. Suitable examples of an agent which can be used for such a surface treatment include an inorganic material such as hydrated aluminium oxide, hydrated silicon oxide, etc.; an organic material such as a polyhydric alcohol, a polyamine, a metal soap, an alkyl titanate, a polysiloxane, etc.; and a mixture of inorganic and organic materials chosen from those as cited above.

It is desirable that such a surface treatment agent as cited above be used in a proportion of from 0.2 to 2.0% by weight to the titanium oxide when it is an inorganic material, while when it is an organic material it be used in a proportion of from 0.1 to 1.0% by weight to the titanium oxide.

The titanium oxide is kneaded into a waterproof resin with a kneading machine, such as a two-rod roll, a three-rod roll, a kneader, a Bumbury's mixer or the like. Therein, a metal salt of higher fatty acid, an ethyl ester of higher fatty acid, a higher fatty acid amide, a higher fatty acid or so on is further used as dispersing aid. The thus titanium oxide-incorporated waterproof resin is molded in the form of pellet, and used as the master batch of titanium oxide.

It is advantageous that the concentration of titanium oxide in the master batch pellet ranges generally from about 30 to about 75%, particularly from 35 to 70%, by weight from the standpoints of economy, dispersibility and so on. As for the dispersing aid, the suitable proportion thereof is generally in the range of about 0.5 to about 10% by weight to the amount of titanium oxide used. The cases in which the titanium oxide concentration in the master batch pellet is less than 30% by weight are too low in dilution ratio, and so they are bad economy. When the foregoing concentration is increased beyond 75% by weight, on the other hand, the dispersibility is lowered and the resulting resin layer tends to generate cracks by bending.

Suitable examples of a bluing agent which can be used include generally known pigments, such as ultramarine, cobalt blue, cobalt phosphate oxide, quinacridone pigments and mixtures of two or more thereof.

As for the bluing agent used in the present invention, it is preferable from the standpoint of improving the resolving power that the grain size thereof be in the range of 0.05 to 5 μm, particularly 0.1 to 3 μm.

In using a bluing agent for the upper layer of the present waterproof resin layers, its content therein is desirably chosen from the range of 0 to 0.56% by weight, preferably 0.05 to 0.4% by weight, and particularly preferably 0.07 to 0.30% by weight. Although sharpness is improved by increasing the content beyond 0.56% by weight, a bluish tinge is given to the image thereby to diminish the value of the resulting material as goods.

When the bluing agent is used in the lower layer of the present waterproof resin layers, it is desirable that its content therein range from 0.05 to 0.60% by weight, preferably from 0.07 to 0.45% by weight, and particularly preferably from 0.10 to 0.30% by weight. When the content is below 0.05% by weight, low-frequency CTF values are lowered, and thereby is lessened the resolution heightening effect.

The bluing agent is kneaded into a waterproof resin with a kneading machine, such as a two-rod roll, a three-rod roll, a kneader, a Bumbury's mixer or the like. The bluing agent-incorporated waterproof resin thus obtained is molded in the form of pellet, and used as the master batch of bluing agent.

From the standpoints of economy, dispersibility and so on, it is desirable that the concentration of a bluing agent in the master batch pellet range from about 1 to about 30%. In forming the master batch pellet, the titanium oxide can be kneaded together, if needed, and a dispersing aid such as a metal salt of higher fatty acid, an ethyl ester of higher fatty acid, a higher fatty acid amide, a higher fatty acid, etc. can be used for assisting the homogeneous dispersion of the bluing agent.

In addition, the waterproof resin layers according to the present invention can contain an antioxidant. As for the proportion of an antioxidant to the waterproof resin, the order of 50–1,000 ppm is desirable from the standpoint of inhibiting the resin from deteriorating without accompanied by adverse effects on photographic properties.

The thus prepared master batch pellets, in which the titanium oxide and/or the bluing agent is incorporated, are properly diluted with a waterproof resin, and used for coating purpose.

Specifically, the foregoing pellets containing the titanium oxide and/or the bluing agent together with the waterproof resin required for dilution are fused by heating, and then spread over a traveling substrate made of natural pulp paper, synthetic paper or the like in the form of melt films according to a successive lamination method or a lamination method using a co-extruding die of feed block type, multi-manifold type, multi-slot type or so on. Thus, the waterproof resin layers constituting the present support can be formed.

Although the present invention has no particular restriction as to the shape of the die used for co-extrusion, it is generally preferred to use a T-die or a coat hanger die.

As for the waterproof resin layers provided on the front side of the support, it is preferable to firstly form the resin layer containing a bluing agent on the front side of the support (on the emulsion-coated side) and then form the titanium oxide-containing waterproof resin layer as a laminate film on the foregoing resin layer by the melt extrusion from a slit die under a temperature ranging from 170° to 290° C.

When the melt extrusion temperature is below 170° C., the waterproof resin cannot undergo sufficient oxidation to result in the lowering of adhesiveness between the waterproof resin layer and the substrate; while when it is above 290° C. the resin layer surface comes to have cracks and die lines, which considerably mar the appearance.

Before it is covered with the resin, the substrate is preferably subjected to an activating treatment, such as a corona discharge treatment, a flame treatment, a glow discharge treatment, a plasma treatment or so on.

As for the present waterproof resin layer which is basically constituted of two layers, it is desirable that the thickness of the upper layer be in the range of 5 to 35 μm, preferably 10 to 25 μm and particularly preferably 15 to 25 μm, and the thickness of the lower layer be in the range of 5 to 30 μm, preferably 10 to 25 μm and particularly preferably 15 to 20 μm.

The topmost surface of the waterproof resin layer on the emulsion-coated side is subjected to a die embossing treatment of the type which can put thereon a gloss or the fine grain described in JP-A-55-26507 or can render the surface mat or silk. On the other hand, the waterproof resin layer on the back side is subjected to another type of die embossing treatment by which the surface is made dull.

The surfaces having received such a die embossing treatment as described above can be subjected to an activating treatment such as a corona discharge treatment, a flame treatment, etc., and further can undergo the subbing treatment as described in JP-A-61-846443.

The substrate used in the present invention may be any kind of paper. Specifically, paper in general which contains natural pulp as a main component, paper made of a natural pulp-synthetic fiber mixture, synthetic fiber paper containing synthetic fibers as a main component, the so-called synthetic paper which can be obtained, e.g., by processing a synthetic resin film, such as a polystyrene film, a polypropylene film, etc., so as to closely resemble to paper in appearance, and so on can be used as the substrate. However, it is particularly favored to use natural pulp paper (which is conventionally called "a raw paper" hereinafter) as the substrate of photographic printing paper.

Specific examples of chemicals which can be added to a raw paper include alkylketene diners, fillers such as clay, talc, calcium carbonate, fine particles of urea resin, etc., a sizing agent such as rosin, higher fatty acid salts, paraffin waxes, alkenylsuccinic acids, etc., a paper strengthening agent such as polyacrylamides, etc., and a fixing agent such as sulfate band, etc. Further, dyes, fluorescent dyes, slime controlling agent, an anti-foaming agent and so on can be added to a raw paper, if needed.

Furthermore, a softening agent can be added, if desired. As for the softening agent, it can be referred to, e.g., *Shin-Kamikako Binran* (which means "New Handbook of Paper Finishing"), pp. 554–555, Shiyaku Times co. (1980). Of the softening agents cited therein, those having a molecular weight of at least 200 are preferred in particular. Such softening agents have a hydrophobic group containing at least 10 carbon atoms and take the form of amine or quaternary ammonium salt which enables self-fixation to cellulose.

Specific examples of such a softening agent include the reaction products of maleic anhydride copolymers with polyalkylenepolyamines, the reaction products of higher fatty acids with polyalkylenepolyamides, the reaction products of urethane alcohols with alkylating agents, and the quaternary ammonium salts of higher fatty acids. In particular, the reaction products of maleic anhydride copolymers with polyalkylenepolyamines and the reaction products of urethane alcohols with alkylating agents are preferred over the others.

On the other hand, a raw paper can also undergo a surface-size treatment with a film-forming polymer, such as gelatin, starch, carboxymethyl cellulose, polyacrylamide, polyvinyl alcohol, modified polyvinyl alcohols, etc. As for the modified polyvinyl alcohols, the polyvinyl alcohols modified with carboxyl groups, those modified with silanols and the copolymers with acrylamides are examples thereof. The coverage of such a film-forming polymer is controlled to from 0.1 to 5.0 g/m$^2$, preferably from 0.5 to 2.0 g/m$^2$.

To the film-forming polymer can further be added an antistatic agent, a brightening agent, a pigment, an anti-foaming agent and so on, if needed.

A pulp slurry which contains pulp and optional additives as described above, including a filler, a sizing agent, a paper strengthening agent, a fixing agent and so on, is made into paper by means of a paper machine such as a Fourdrinier machine, dried and then rolled up to prepare a raw paper. Before or after the drying operation, the paper can be subjected to a surface-size treatment as described above. In addition, the paper undergoes a calendering treatment in a period between the drying and rolling-up operations.

In the case where the paper undergoes a surface-size treatment after the drying operation, the calendering treatment can be carried out either before or after the surface-size treatment. However, it is desirable that the calendering treatment be carried out after other intended treatments, or at the final stage of finishing. In the calendering treatment described above, there can be used conventional metal rolls and spring rolls used for papermaking.

The raw paper used for the present photographic printing paper support is prepared so as to finally attain a thickness of from 50 to 250 μm by the calendering treatment as described above. The density of the raw paper ranges from 0.8 to 1.3 g/m$^3$, preferably from 1.0 to 1.2 g/m$^3$.

The photographic printing paper support according to the present invention can be coated with various backing layers for the purposes of prevention of charging, curling or other phenomena. In such backing layers can be contained properly chosen and combined additives. Such additives include the inorganic and organic antistatic agents, the hydrophilic binders, the latexes, the hardeners, the pigments and the surfactants disclosed or recited in JP-B-52-18020, JP-B-57-9059, JP-B-57-53940, JP-B-58-56859, JP-A-59-214849 and JP-A-58-184144.

The photographic printing paper support according to the present invention is coated with various photographic constituent layers, and serves for the various purposes, as color photographic printing paper, black-and-white photographic printing paper, printing paper for photocomposition, reversal photographic materials, negative and positive materials for silver salt diffusion transfer process, graphic arts materials and so on. For instance, those photographic constituent layers can include an emulsion layer comprising silver chloride, silver bromide, silver chlorobromide, silver iodobromide or silver chloroiodobromide, color coupler-incorporated silver halide emulsion layers for a multilayer color photographic material, or a silver salt diffusion transfer image-receiving layer in which physical development nuclei are incorporated.

In accordance with the present invention, the titanium oxide content in a photographic printing paper support can be reduced. As a result of it, the present support not only can have excellent production suitability but also can be produced at a lower price than conventional ones. When the present support is used as a support of photographic printing paper, the resulting photographic printing paper can be prevented from suffering the fuzzy image formation attributable to a printing operation. Therefore, the present support has a great advantage in that it can ensure high resolving power to photographic printing paper.

The present invention will now be illustrated in more detail by reference to the following examples. However, the invention should not be construed as being limited to these examples.

EXAMPLE 1

A paper substrate 1 (See FIG. 1) having a basis weight of 170 g/m$^2$ was surface-treated by corona discharge having an output of 1 KW, and a low density polyethylene resin (density: 0.94 g/cm$^3$, a melt index: 3.0) was extrusion-laminated on the back side thereof at a line speed of 200 m/min under a temperature of 260° C. to form a waterproof resin layer 4 having a thickness of 40 μm.

Figure 1:
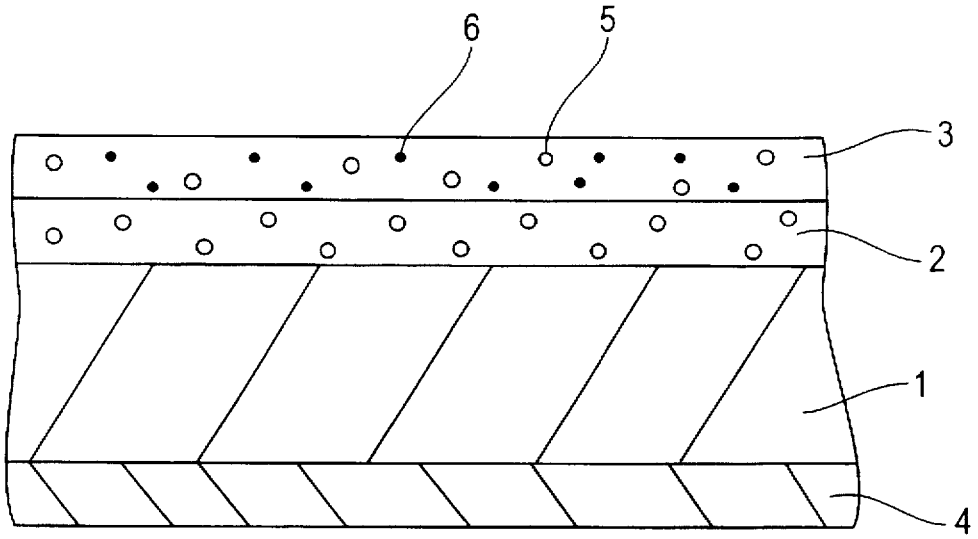
FIG. 1 is a cross sectional view showing part of the present support for photographic printing paper.
Figure 2:
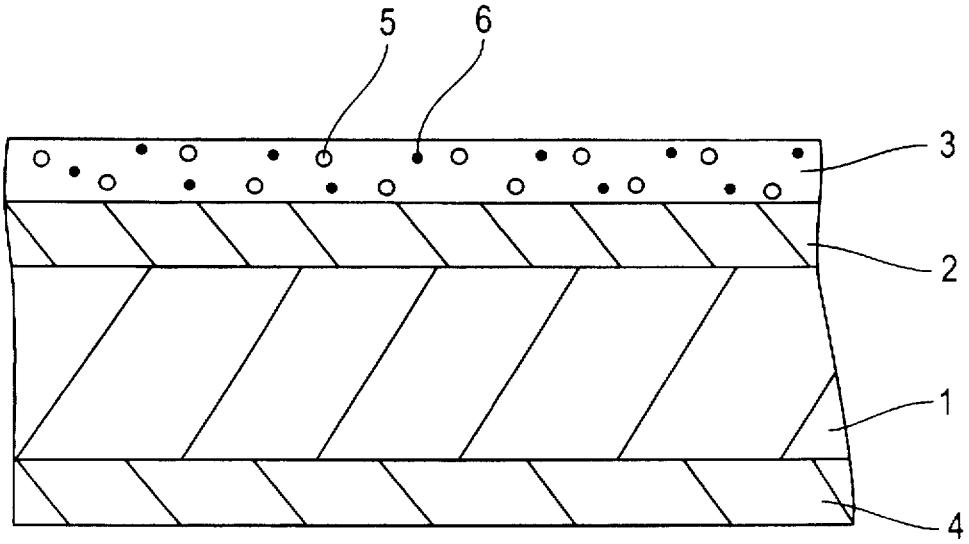
FIG. 2 is a cross sectional view showing part of a conventional support for photographic printing paper, wherein the waterproof resin layer on the emulsion-coated side is constituted of two layers and the lower layer of the two does not contain any bluing agent.
Figure 3:
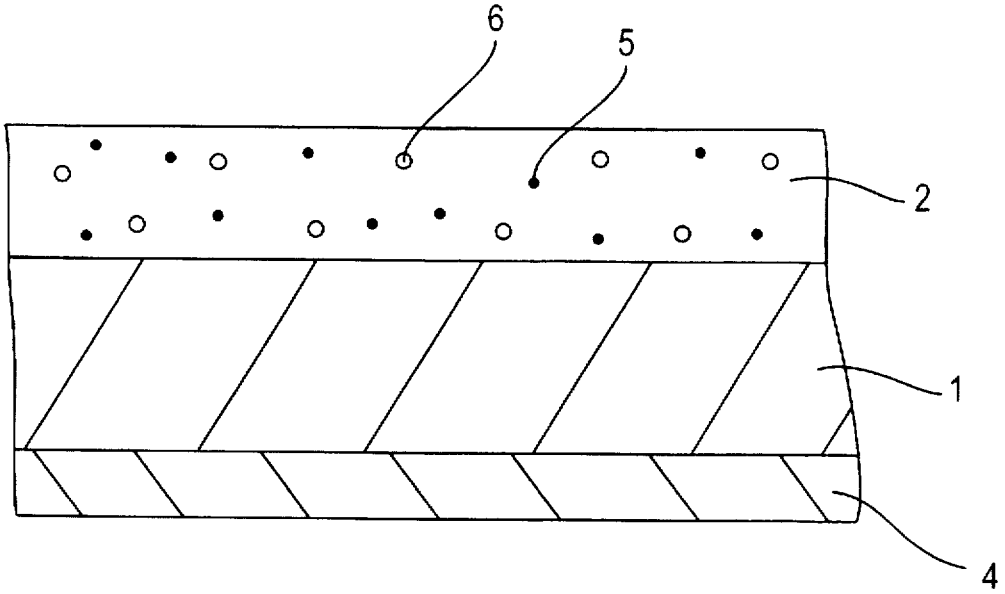
FIG. 3 is a cross sectional view showing part of another conventional support for photographic printing paper, wherein the water proof resin layer on the emulsion-coated side is a single layer.

Then, a bluing agent-containing waterproof resin layer 2 (lower layer) and a titanium oxide-containing waterproof resin layer 3 (upper layer), whose compositions and the thicknesses are set forth in Table 1, were coextrusion-laminated on the front side (or the emulsion-coated side) of the paper substrate 1 under the same condition as described above to prepare a photographic printing paper support according to the present invention (See FIG. 1).

TABLE 1

| Layer No. | Ingredient | Proportion (wt %) | Thickness |
|---|---|---|---|
| 3 (upper) | Low-density polyethylene (density: 0.918 g/cm$^3$) | 80.0 | 20 μm |
| | Anatase-type titanium oxide (surface coating: treatment with 0.4% $Al_2O_3$) | 20.0 | |
| | Ultramarine | 0 | |
| 2 (lower) | Low-density polyethylene (density: 0.918 g/cm$^3$) | 99.93 | 20 μm |
| | Ultramarine | 0.07 | |

The thus obtained support was coated with color emulsions to provide a photographic printing paper. Then, the photographic printing paper was subjected to printing and developing operations, thereby obtaining a photograph.

The photograph obtained was examined for resolving power by visual observation. In evaluating the resolving power, the observation result was classified into 10 grades, and the grade 5 as a standard was given to the resolving power of a conventional case (Comparative Example 5 described hereinafter), wherein a single waterproof resin layer was provided. The evaluation result is shown in Table 2.

EXAMPLE 2 AND COMPARATIVE EXAMPLES 1 TO 5

Photographic printing paper supports were prepared in the same manner as in Example 1, except that the compositions of the upper and the lower waterproof resin layers were changed to those set forth in Table 2 respectively. Additionally, the waterproof resin layer in Comparative Example 5 was not divided into two layer, but it was formed into a single layer having a thickness of 40 μm. The same color emulsions as used in Example 1 were coated on each of these supports to produce photographic printing papers. The thus produced printing papers were each subjected to the same printing and developing operations as in Example 1, and examined for resolving power by the same method as in Example 1. The results obtained are shown in Table 2.

TABLE 2

| | | Composition | | | |
|---|---|---|---|---|---|
| | Layer No. | Low-density Polyethylene (wt %) | Titanium Dioxide (wt %) | Bluing Agent (wt %) | Resolving Power |
| Example 1 | 3 | 80.0 | 20.0 | 0 | 8 |
| | 2 | 99.93 | 0 | 0.07 | |
| Example 2 | 3 | 89 | 11 | 0 | 7 |
| | 2 | 99.93 | 0 | 0.07 | |
| Comparative | 3 | 79.93 | 20 | 0.07 | 7 |
| Example 1 | 2 | 100 | 0 | 0 | |
| Comparative | 3 | 79.93 | 20 | 0.07 | 8 |
| Example 2 | 2 | 94 | 6 | 0 | |
| Comparative | 3 | 88.93 | 11 | 0.07 | 5 |
| Example 3 | 2 | 100 | 0 | 0 | |
| Comparative | 3 | 88.93 | 11 | 0.07 | 7 |
| Example 4 | 2 | 91 | 9 | 0 | |
| Comparative Example 5 | single layer | 89.965 | 10 | 0.035 | 5 |

Making a comparison between the samples having the same titanium oxide content, it is proved by the above table that the support containing a bluing agent in the upper layer alone is inferior in resolving power to the support containing it in the lower layer alone. In particular, the distinction in resolving power is remarkable between the samples which are reduced in titanium oxide content (as can be seen in the comparison between Comparative Example 3 and Example 2). As a reason why such a distinction is brought about, it can be thought that the support containing no bluing agent in the lower layer suffers diffused reflection of light by the substrate surface.

EXAMPLES 3 TO 4 AND COMPARATIVE EXAMPLE 6

Photographic printing paper supports were prepared in the same manner as in Example 1, except that the content of the bluing agent in the lower layer 2 was changed to 0.28 wt % (Example 3), 0.56 wt % (Example 4) and 0.84 wt % (Comparative Example 6), respectively. The same color emulsions as used in Example 1 were coated on each of these supports to produce photographic printing papers. The thus produced printing papers were each subjected to the same printing and developing operations as in Example 1, and examined for resolving power by the same method as in Example 1.

The examination results showed that the resolving power was heightened with an increase in bluing agent content. However, the photograph came to assume a stronger tinge of blue the higher the bluing agent content became, and so the sample having the bluing agent content of 0.84 wt % was undesirable from the practical viewpoint of image quality.

EXAMPLE 5 AND COMPARATIVE EXAMPLES 7 AND 8

Photographic printing paper supports were prepared in the same manner as in Example 2, wherein the amount of blueing agent added to the upper and the lower waterproof resin layers were changed to those set forth in Table 3 respectively, while the total amount of blueing agent was kept constant.

TABLE 3

| | | Composition | | |
|---|---|---|---|---|
| | Layer No. | Low-density Polyethylene (wt %) | Titanium Dioxide (wt %) | Blueing Agent (wt %) |
| Example 2 | 3 | 89.00 | 11 | 0.00 |
| | 2 | 99.93 | 0 | 0.07 |
| Example 5 | 3 | 88.98 | 11 | 0.02 |
| | 2 | 99.95 | 0 | 0.05 |
| Comparative | 3 | 88.96 | 11 | 0.04 |
| Example 7 | 2 | 99.97 | 0 | 0.03 |
| Comparative | 3 | 88.94 | 11 | 0.06 |
| Example 8 | 2 | 99.99 | 0 | 0.01 |
| Comparative | 3 | 88.93 | 11 | 0.07 |
| Example 3 | 2 | 100 | 0 | 0.00 |

The same color emulsions as used in Example 1 were coated on each support to produce photographic printing papers. The thus produced printing papers were each subjected to the same printing and developing operations as in Example 1, and the resolving powers thereof were evaluated by determining the CTF value as defined in U.S. Pat. No. 4,389,455. As for the CTF value, the greater it is the higher the resolving power.

The evaluation results obtained are shown in FIG. 4. As can be seen from FIG. 4, higher resolving power was obtained when the blueing agent was added in a greater amount to the lower layer than to the upper layer, when the total amount of the blueing agent added was constant.

EXAMPLES 6 AND 7, AND COMPARATIVE EXAMPLES 9, 10 AND 11

Photographic printing paper supports were prepared in the same manner as in Example 1, except that the amount of titanium oxide used was increased to 25 wt % and the amount of the blueing agent added was changed as set forth in Table 4, respectively.

TABLE 4

| | | Composition | | | |
|---|---|---|---|---|---|
| | Layer No. | Low-density Polyethylene (wt %) | Titanium Dioxide (wt %) | Blueing Agent (wt %) | Thickness (μm) |
| Comparative | 3 | 74.30 | 25 | 0.70 | 20 |
| Example 9 | 2 | 99.50 | 0 | 0.50 | 20 |
| Comparative | 3 | 74.50 | 25 | 0.50 | 20 |
| Example 10 | 2 | 99.30 | 0 | 0.70 | 20 |
| Example 6 | 3 | 74.44 | 25 | 0.56 | 20 |
| | 2 | 99.40 | 0 | 0.60 | 20 |
| Comparative | 3 | 74.44 | 25 | 0.56 | 20 |
| Example 11 | 2 | 100.00 | 0 | 0.00 | 20 |
| Example 7 | 3 | 75.00 | 25 | 0.00 | 20 |
| | 2 | 99.44 | 0 | 0.56 | 20 |

The same color emulsions as used in Example 1 were coated on each of these supports to produce photographic printing papers. The thus produced printing papers were each subjected to the same printing and developing operations as in Example 1, and the resolving powers thereof were evaluated by determining the CTF value as defined in U.S. Pat. No. 4,389,455.

The results obtained are shown in FIG. 5. FIG. 5 demonstrates generally that higher resolving power was obtained when the blueing agent was added in a greater amount.

However, the addition of blueing agent in too great an amount, as in Comparative Examples 9 and 10, is undesirable because the photographs obtained had a strong blue tinge. Further, as can be seen from the comparison between Example 7 and Comparative Example 11, and the comparison between Example 6 and Comparative Example 9, resolving power is increased when the upper layer contains less blueing agent than the lower layer.

What is claimed is:

1. A photographic printing paper support having waterproof resin layers on both sides of a substrate, said waterproof resin layer on the side where emulsions are to be coated comprising at least an upper layer containing from 5 to 25% by weight of titanium oxide and from 0 to 0.56% by weight of a bluing agent and a lower layer containing substantially no titanium oxide but containing from 0.05 to 0.60% by weight of a bluing agent, and wherein the upper layer contains less bluing agent than the lower layer.

2. A photographic printing paper support according to claim 1, wherein the bluing agent has a grain size of from 0.05 to 5 μm.

3. A photographic printing paper support according to claim 1, wherein the upper layer has a thickness of from 5 to 35 μm and the lower layer has a thickness of from 5 to 30 μm.

4. A photographic printing paper support according to claim 1, wherein the upper layer contains titanium oxide in a proportion of from 10 to 20% by weight.

5. A photographic printing paper support according to claim 1, wherein the upper layer contains a bluing agent in a proportion of from 0.05 to 0.4% by weight.

6. A photographic printing paper support according to claim 2, wherein the bluing agent is a pigment chosen from a group consisting of ultramarine, cobalt blue, cobalt phosphate oxide, quinacridone pigments and mixtures of two or more thereof.

7. A photographic printing paper support according to claim 1, wherein the titanium oxide has an average grain size ranging from 0.1 to 0.4 μm.

8. A photographic printing paper support according to claim 7, wherein the titanium oxide is titanium dioxide having the surface treated with hydrated aluminium oxide, hydrated silicon oxide, a polyhydric alcohol, a polyamine, a metal soap, an alkyl titanate, a polysiloxane or a mixture of two or more thereof.

9. A photographic printing paper support according to claim 1, wherein the waterproof resin is a resin having a melt flow rate in the range of 1.2 to 100 g/10 minutes.

10. A photographic printing paper support according to claim 9, wherein the waterproof resin is low-density polyethylene, linear low-density polyethylene, high density polyethylene or a mixture of two or more thereof.

* * * * *